US005641000A

United States Patent [19]

Johansson

[11] Patent Number: 5,641,000

[45] Date of Patent: Jun. 24, 1997

[54] AUTOMATIC BOBBIN CHANGING IN A WEAVING MACHINE

[75] Inventor: Hans Johansson, Älmhult, Sweden

[73] Assignee: Texo AB, Almhult, Sweden

[21] Appl. No.: 429,844

[22] Filed: Apr. 27, 1995

[30] Foreign Application Priority Data

Apr. 27, 1994 [SE] Sweden ..... 9401435

[51] Int. Cl.[6] ..... D03D 43/00

[52] U.S. Cl. ..... 139/245

[58] Field of Search ..... 139/224, 241, 139/245, 246, 247, 242, 243, 244, 225, 234, 238, 239, 240

[56] References Cited

U.S. PATENT DOCUMENTS

| | | | |
|---|---|---|---|
| 787,497 | 4/1905 | Cosserat | 139/245 |
| 1,703,909 | 3/1929 | Turner | 139/245 |
| 2,139,994 | 12/1938 | Bird . | |
| 2,421,532 | 6/1947 | Welti | 139/245 X |
| 2,474,632 | 6/1949 | Krukonis | 139/245 |
| 3,144,052 | 8/1964 | Klock . | |
| 3,144,452 | 8/1964 | Wild et al. . | |

*Primary Examiner*—Andy Falik

*Attorney, Agent, or Firm*—Pollock, Vande Sande & Priddy

[57] ABSTRACT

A method and apparatus for automatically changing a bobbin in at least one shuttle of a weaving machine which carries thread from one side of material produced by the weaving machine to the other side of the material. The weaving machine includes a bobbin changer having at least one bobbin and device for joining thread together. The bobbin changer is moveable between a first weaving position at a height level above the material and on a side edge of the material and a second bobbin change position above a shuttle race level and at least partly over the material upon each change of the bobbin. At least one shuttle is positioned in a first position corresponding to the second bobbin change position of the bobbin changer and a change of the bobbin in the shuttle is effected.

18 Claims, 3 Drawing Sheets

AUTOMATIC BOBBIN CHANGING IN A WEAVING MACHINE

TECHNICAL FIELD

The present invention relates to a method for automatic bobbin changing in one or more shuttles of a weaving machine. Each shuttle can be introduced into a shuttle race and can be acted on to transfer the carried yard/thread from one side of the material/felt/weave, which is being produced in the weaving machine, to the other side of the material. Upon each change of bobbin in each shuttle, the shuttle is brought to a bobbin change position. Then a bobbin changer device is activated for bobbin changing and for joining together, preferably welding together, the yarn part issuing from the weave, felt and the like, and the yarn of the new bobbin. This invention also relates to a weaving machine with an automatic bobbin-changing function for one or more shuttles. Each shuttle can be introduced into a shuttle race and acted on to bring yarn/thread from the one side of the material (weave/felt) of the warp to the other side of the material of the warp. A bobbin changer device can be activated for bobbin changing and for joining together, for example welding together, the yarn part issuing from the material and the yarn of the new bobbin.

BACKGROUND OF THE INVENTION

Existing automatic bobbin-changing is used in, among other things, the weaving of endless felts, in which weaving use is made of shuttles which carry the weft yarn wound on a bobbin. The amount of thread wound on is sufficient only for 3 to 5 minutes of continuous weaving, and then the weaving machine has to be stopped and the empty bobbin has to be changed manually. This type of weaving means that each weaving machine has to be manned, otherwise the waiting time for bobbin changing may be too long if one and the same weaver is expected to attend to several weaving machines. This results either in high costs, caused by having one weaver per machine, or in a low efficiency, when one weaver is expected to attend to several machines, and both these alternatives are unfavorable with respect to production.

It is known to make use of so-called automatic bobbin changers which are offered for sale on the market. A possible example of these known bobbin changers is the bobbin changer sold on the market by the brand name Jürgens, Emsdetten, Germany.

The solutions which have been proposed in connection with the known automatic bobbin changers have serious disadvantages. Among other things, each bobbin is changed at the level of the shuttle race, which means that, in order to make room for the mechanics, the maximum weaving width of the weaving machine has to be reduced, or the side of the weaving machine has to be extended to provide room for the automatic bobbin changer. Such reductions of the maximum weaving width in most cases represent an unacceptable alternative. In many of the present day weaving mills, extensions to the weaving machine are quite impossible due to lack of space. The invention aims to solve these problems, among others.

In cases where automatic bobbin changers are used, it is important to be able to retain the existing functions of the weaving machine. Thus, for example, the spaces around the machine must not be limited to the extent that restrictions are placed on the drawing-in position of the machine. In such a drawing-in position, it will be possible to load the weaving machine for starting up a new weave. The invention also solves this problem.

It is also important to maintain the safety aspects of the weaving machine despite the introduction of the automatic bobbin-changing function. Thus, there must be no possibility of any danger arising when, for example, loading bobbins into the bobbin magazine of the automatic device while the weaving machine is running. The invention aims to solve this problem too.

It should be possible to use the automatic bobbin changer devices as additional equipment on already existing machines. The present invention solves this problem. In this respect, it will be possible to carry out so-called manual weaving despite the introduction or integration of the automatic device with the weaving machine functions. The present invention solves this problem too.

On account of the different space availabilities, there is a desire that it should be possible to apply the additional function of automatic bobbin changing on any chosen side of the machine, that is, either on the left-hand side or the right-hand side of the machine. The present invention solves this problem, too.

The automatic bobbin changer device should be able to work with a large number of bobbins, for example up to 40 bobbins, which gives approximately 3 working hours. In addition, it should be possible for the bobbin changer to have a simple constructional design and be built onto, or integrated with, existing weaving machines, newly produced weaving machines, or weaving machines which are in production. The present invention solves this problem, too.

SUMMARY OF THE INVENTION

The characteristic feature of the present invention is, among other things, that the bobbin changer position is located at a point above the shuttle race and preferably over areas of the material/warp. Furthermore, the bobbin changer device is made to perform its tasks above the material/warp, and preferably partly within the relevant side edge of the material/warp.

In further developments of the inventive concept, a bobbin changer compartment for each shuttle is formed by the bobbin changer device and the reed or sley of the weaving machine. Each shuttle which is to change its bobbin is transferred to the bobbin changing position, where the shuttle is fixed in its position during the actual bobbin change. The weaving machine operates with a shuttle changer which, in addition to placing the respective shuttle in the shuttle race, also operates at a position or a level above the shuttle race, where the respective shuttle which is to change bobbin can be removed, for example by the longitudinal displacement of the shuttle, to the bobbin changer compartment. In one embodiment, the bobbin changer device can be allocated any one of three positions. In a first position, the bobbin change takes place. In a second position, the weaving machine is allowed to perform its weaving function. In a third position, the bobbin changer device is moved to a height setting substantially above the weave/felt/warp, where the drawing-in work can be carried out in or on the machine.

In connection with the formation of the bobbin changer compartment by means of the reed or the sley, the bobbin changer device can be assigned various tilting positions in which it adapts to the exact position at which the reed or the sley has stopped at or near the limit edge of the material.

The characteristic feature of the present invention is that a bobbin changer position is arranged at a level which is above that of the shuttle race and preferably completely or partially within the relevant side edge of the material/the warp, and that the bobbin changer device effects the bobbin-changing function from a position above the material/the warp and at least partially within the side edge.

In further developments of the inventive concept, it is proposed that each shuttle which undergoes a bobbin change can be transferred from a position in a shuttle changer to a bobbin changer compartment, the transfer preferably taking place by the longitudinal displacement of the shuttle. The bobbin changer device is preferably arranged in such a way as to form, together with the reed or sley of the weaving machine (when the reed or sley assumes a position at or near a limit edge obtained in the material), the bobbin changer position or bobbin changer compartment. The bobbin changer device operates with preferably three different height settings. The bobbin changer device is preferably mounted on one or more guides in the upper structure of the weaving machine. In addition, the device is mounted so that it can tilt in order to be able to adapt to the current stop position of the reed or the sley upon each formation of the bobbin changer compartment. The bobbin change is initiated preferably by means of a member indicating a predetermined degree of unwinding, for example a reflection member. The bobbin changer compartment includes members for securely holding the shuttle present in the bobbin changer compartment. The bobbin changer device is likewise provided with transporting members that impart clear-cut displacement movements to the bobbins in the magazine. The bobbins can be identical, that is, carry the same type of thread. The bobbins can also comprise different types of thread, different colors of thread, and the like.

With the above features, an effective bobbin changer function is obtained which can be added to existing weaving machines or to weaving machines which are in production. Despite the bobbin changer function, no extensions need be made to the machine side in question. The bobbin changer functions can operate with functions which are known and which in addition are technically simple to use. As far as manual functions of the weaving machine are concerned, these can, if so desired, continue to be used as before or with the bobbin-changing function. Former weaving widths can be obtained on the weaving machine. Reference is also made to Swedish Patent Application 9400223-5 by the same applicant and inventor. This patent application proposes the use of a yarn-trapping function which makes it easier for each weft yarn to be kept under control. This allows loading the bobbin magazine with bobbins without having to stop the weaving machine, by virtue of the fact that the weft yarn can be kept under control with the aid of the proposed yarn-trapping function. In this connection it is possible to avoid using other types of complicated yarn control which can be dangerous for the personnel concerned to carry out, when the machine is in operation, because there may be a risk of getting one's fingers caught. Since the bobbin changer can be placed easily in a drawing-in position assigned to it, it is possible to carry out manual weaving, if so desired, without at the same time disturbing the drawing-in function.

BRIEF DESCRIPTION OF THE DRAWINGS

A presently proposed embodiment of a method and an arrangement according to the invention will be described hereinbelow with reference to the attached drawings, in which.

DETAILED DESCRIPTION OF THE PREFERRED EMBODIMENT

Figure 1:
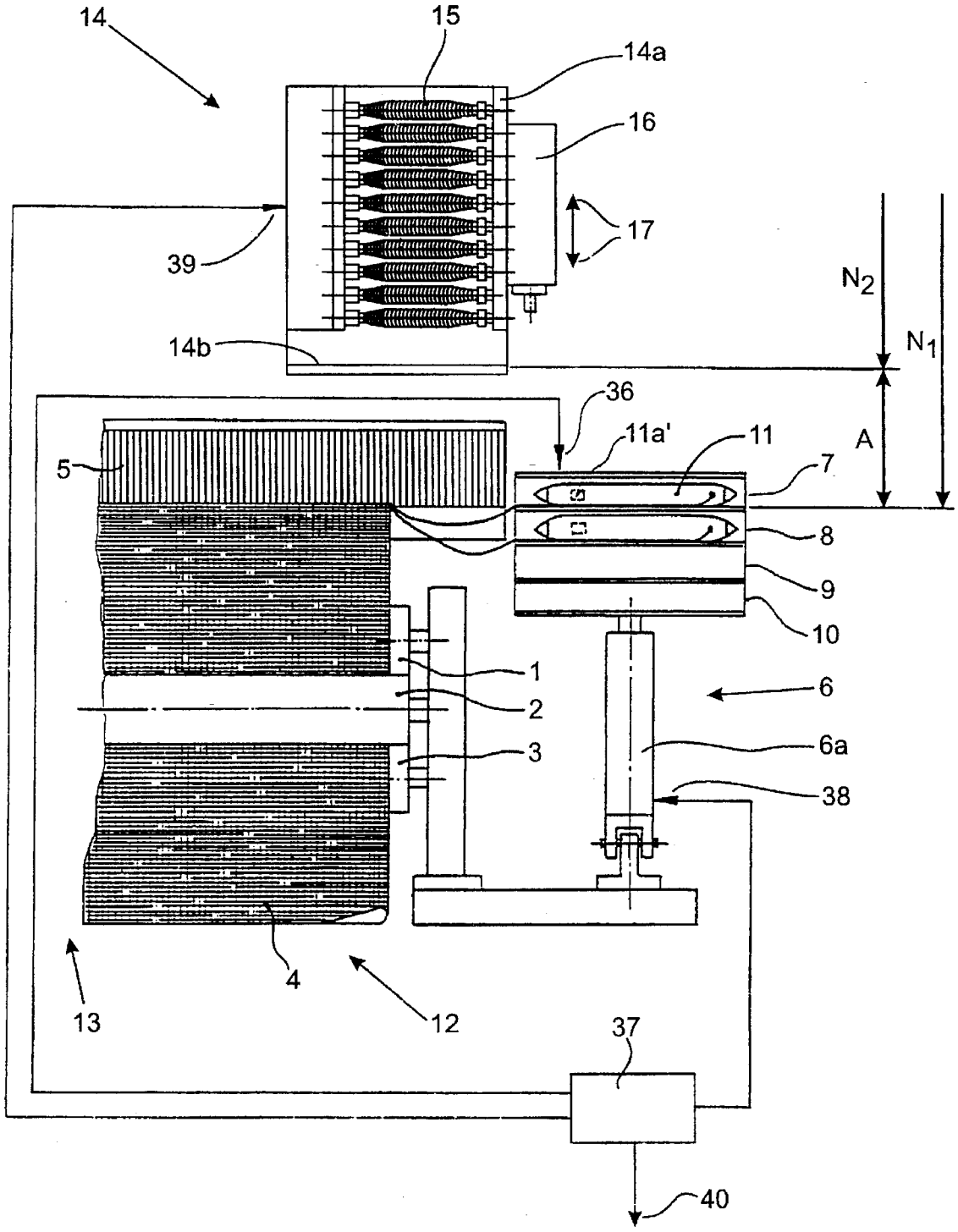
FIG. 1 shows, in an end view of the weaving machine, and in partial cross section, the bobbin-changing function provided on the weaving machine, with the components involved being in their respective first positions.

The method and the device according to the present invention differ from the prior art principally in that each bobbin for each shuttle is changed at a level above the level of the shuttle race, at a position which is situated over the woven felt/warp and within the relevant side edge of the felt or the warp, the result and advantage of this being that the maximum weaving width can be maintained. In FIG. 1, three cloth beams are indicated by 1, 2 and 3. A woven felt is labelled as 4. In addition, a reed or sley is shown by 5. The weaving machine also includes a shuttle changer 6 which is known and which can operate with five positions. The shuttle changer is designed with four compartments 7, 8, 9 and 10. The shuttle changer can be of the type which comprises a cylinder *6a* which, in a known manner, can set the compartments 7, 8, 9 and 10 at different heights. Thus, in FIG. 1, the compartment 7 is set at a level which corresponds to the shuttle race. A shuttle placed in the compartment 7 can thus be transferred from a first side 12 of the weave/felt/warp to a second side 13 of the same. The transfer can be effected in a known manner. As regards the basic functions of the weaving machine in the respects mentioned here, reference may be made to the weaving machines sold by TEXO AB, Sweden, for wires. The shuttle race level is indicated by the arrow N1.

In accordance with the present invention, the weaving machine according to FIG. 1 comprises an automatic bobbin changer device 14. The bobbin changer device comprises one or more magazines with bobbins 15. Thus, for example, the device 14 can comprise a magazine with 4 vertical rows of 10 bobbins, one of the rows being shown in FIG. 1. The bobbin changer also comprises members for joining yarn or thread. In the illustrative embodiment, the joining members 16 include a welding device of a known type. The welding device is vertically displaceable in the directions of the arrows 17 relative to the frame *14a* of the bobbin changer. In the present case, the bobbin changer device is at a height setting which is here called the weaving position. The level at the weaving position is indicated by N2. The vertical distance A has been chosen as 274 mm in this case. The distance A can of course be different and is calculated from the shuttle race to the bottom edge or underside *14b* of the bobbin changer.

Figure 2:
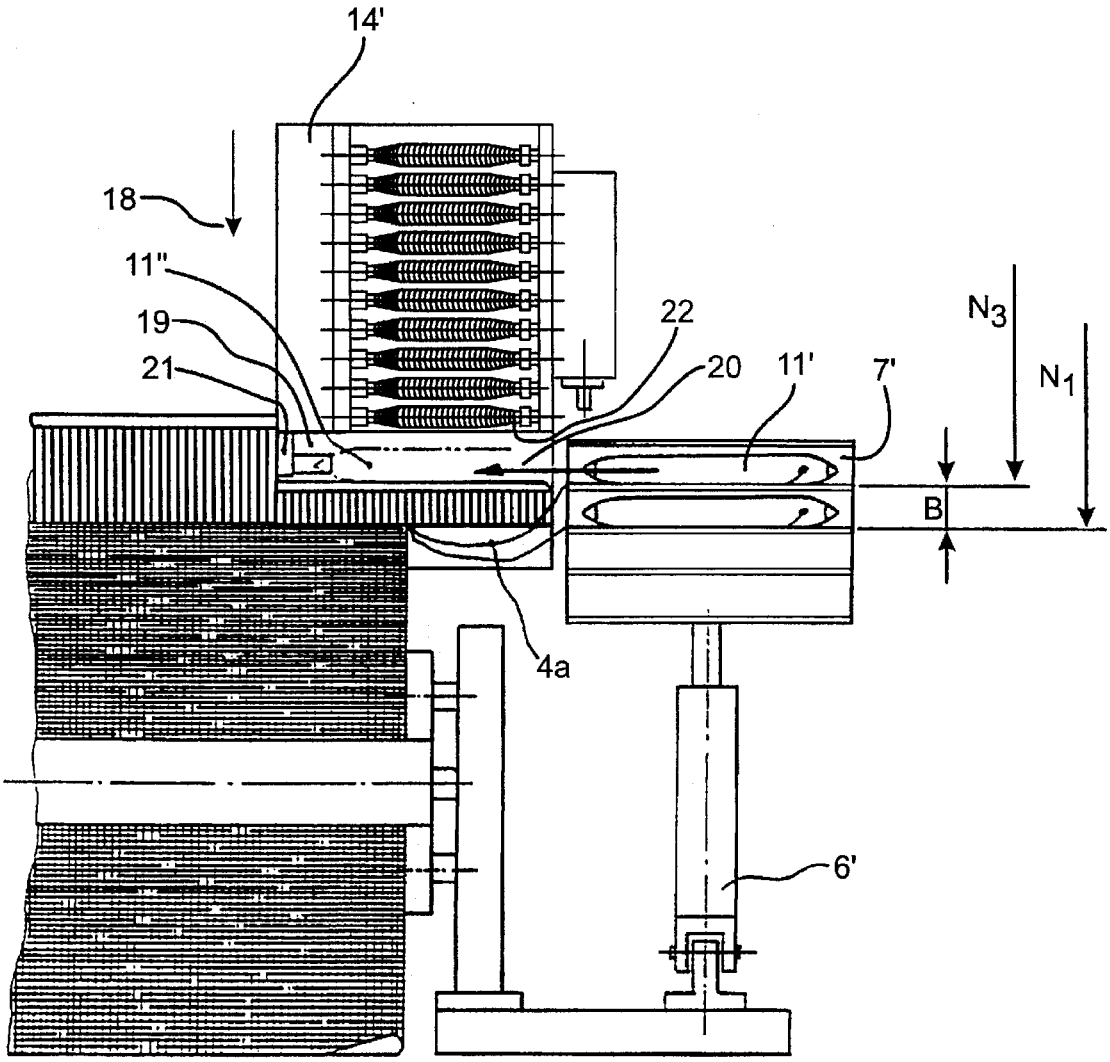
FIG. 2 illustrates the device as in FIG. 1, but with the components being in their respective second positions.

In accordance with FIG. 2, the bobbin changer can be assigned a lowered position at a change-over level which in FIG. 2 is indicated by N3. In FIG. 2 it has been assumed that the shuttle 11' in the uppermost compartment 7' of the shuttle changer 6' is to be changed. The shuttle changer has therefore set the compartment 7' at the change-over level N3, which is located above the level N1 of the shuttle race. The vertical distance B between the levels N1 and N3 has been chosen as about 74 mm in the present case. The distance B can also be varied without deviating from the inventive concept. The direction of the vertical movement (the lowering movement) has been indicated by the arrow 18. The bobbin changer device 14' forms, together with the reed or sley (see below), a bobbin changer compartment 19, in which the shuttle 11' can be brought to a position 11" by longitudinal displacement in the direction of the arrow 20.

Longitudinal displacement members are designated by 21 and can be placed in the bobbin changer compartment 19 or in the shuttle changer compartment 7'. These longitudinal displacement members 21 can be of known types. The bobbin-changing function itself is also assumed to be known, and in this respect reference may be made to the functions of the above mentioned automatic bobbin changer sold on the market. The bobbin-changing function also includes welding the yarn part 4*a*, issuing from the felt/weave/material in question, to the yarn part 22 of the bobbin in question. Reference is also made to the above cited Swedish patent application.

Figure 3:
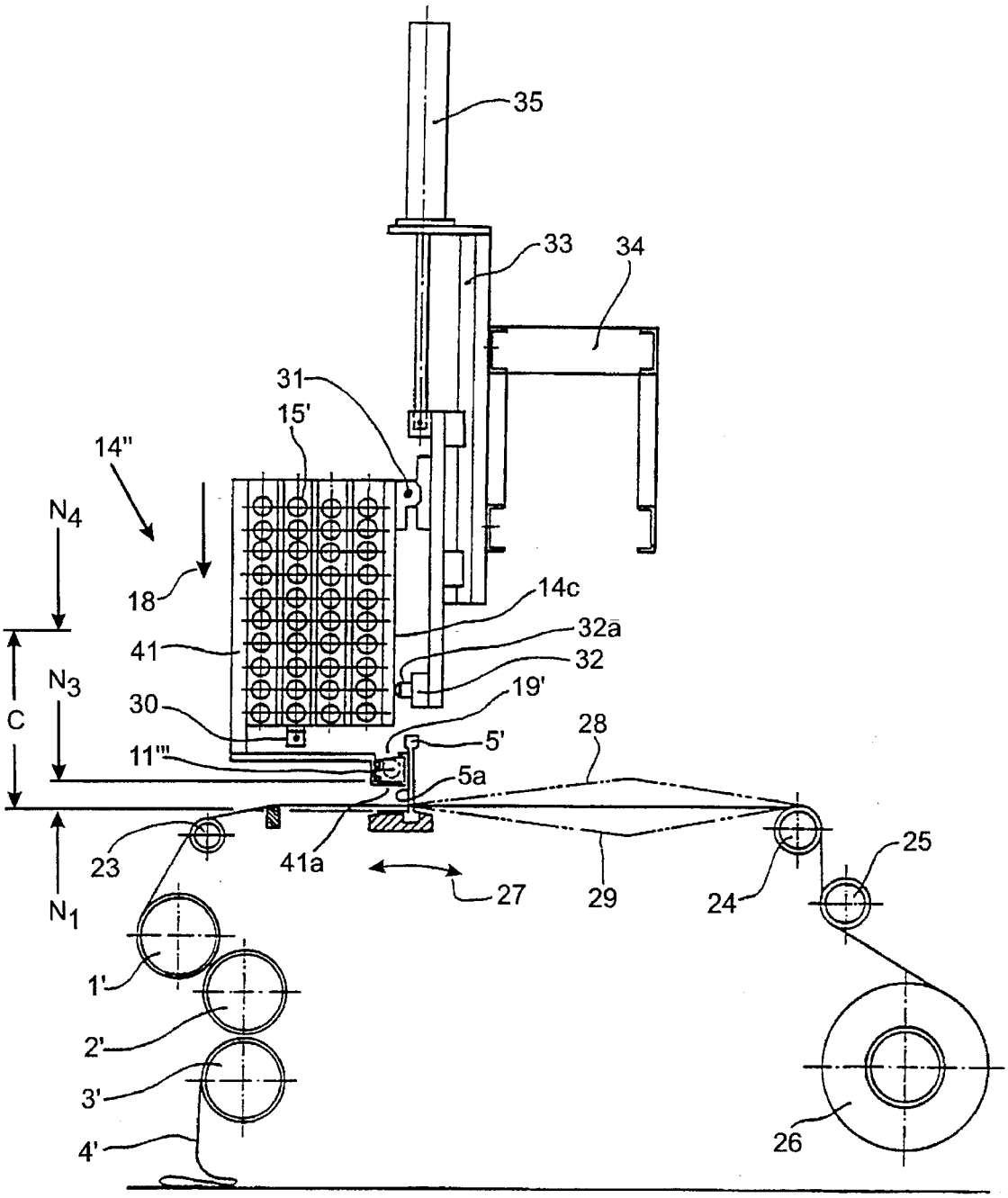
FIG. 3 shows, in a vertical view from the side, the automatic bobbin changer arranged on or by a weaving machine, which has been symbolized by its relevant parts.

The view shown in FIG. 3 also illustrates, in addition to the components which have been mentioned, a breast beam 23, a back rest 24 and a guide roll 25. A warp beam is further indicated by 26. The movement of the reed or sley 5' is shown by the arrows 27. The warp shed has been shown by broken lines 28 and 29. The FIGURE also reveals that the bobbin changer device 14" is provided with a frame part 41 which has, in its lower areas, a portion 41*a* which can bear against the front side 5*a* of the reed or sley 5' The portion 41*a* is designed for forming the bobbin changer compartment 19' The position of the relevant shuttle in the bobbin changer compartment is indicated by 11'". The view according to FIG. 3 also shows all the rows of bobbins 15'. The bobbins can be transferred by transfer members which are symbolized by 30 and which are of a known type. The transfer members are arranged to impart to each bobbin, at each bobbin change, clear-cut displacement movements to the compartment 19'.

The device 14" can be tilted about a bearing point/bearing shaft 31, the tilting being executed in the plane of the paper. The tilting movement is effected by means of a swing cylinder 32, which is of a known type, by allowing the piston 32*a* of the swing cylinder to act on a frame part 14*c*. As above, the whole device can be displaced vertically, the bobbin change-over level N3' being adopted in FIG. 3. The vertical displacement takes place on one or more guides 33 arranged in the upper structure of the weaving machine symbolized by 34. A level N4 is indicated in FIG. 3. The bobbin changer device can be brought to this height setting, so that its lower areas arrive at or are situated near the level N4. The vertical displacement movements for the bobbin changer device can be effected by means which are known. In FIG. 3, a cylinder acting in the vertical direction has been indicated by 35.

By means of what has been indicated above, a preliminary securing of the shuttle, which has been introduced into the bobbin changer compartment 19', can be obtained with the device and the sley. A definitive securing of the shuttle is effected by members that are known and, therefore, not specifically shown. In FIG. 1, a reflection surface is indicated by 11*a'*. As this reflection surface is exposed after a predetermined degree of unwinding of the yarn on the shuttle in question, an indication of this is obtained with the aid of the reflection surface. Reading or sensing members that react to the exposure of the reflection surface can consist of members that are known and that are symbolized by 36 in FIG. 1. Members 36 initiate a control unit 37, which in turn sends control signals 38 and 39 to the shuttle changer and the automatic unit, respectively. A stop signal 40 for the machine is also initiated. The automatic unit in the bobbin changer device can operate internally as a function of control signals coming from outside (for example, the control 39). One or more of the various part-functions in the bobbin changer device can alternatively be controlled from the control unit 37.

Level N4 (see FIG. 3) is arranged at a distance C which, in the shown embodiment, is chosen at about 674 mm above the level of the shuttle race. Level N4 of the bobbin changer device permits the drawing-in position, in which handling of the yarn is made easier when starting-up the weaving machine with new weave, so-called drawing-in. In the shown embodiment, a 4-cell shuttle box which is maneuvered with a shuttle changer having 5 positions, that is, 5 cell divisions, has been used. The fifth position is used, upon bobbin change-over, for lifting the shuttle box one position above the level of the shuttle race. Different number of cells and shuttle changer positions can of course be used in connection with the present invention. The present position of the reed or shuttle can vary from one stop to another. Even if the variation is small, it is important that the arrangement in accordance with the above takes care of these variations. With the aid of the swing cylinder and the weight of the device, the change-over compartment is laid against the front side of the reed, and stop variations are eliminated. The limit edge of the weave 4 is designated as 4*b*.

The present invention is not limited to the embodiment shown above by way of example, but instead can be modified within the scope of the attached patent claims and the inventive concept.

I claim:

1. A method for automatically changing a bobbin in at least one shuttle of a weaving machine which carries thread from one side of material produced by said weaving machine to the other side of said material, the weaving machine including means for bobbin changing which comprise at least one bobbin and means for joining yarn/thread together, said method comprising the steps of:

placing said bobbin changing means at a first weaving position at a height level above said material and on a side edge of said material;

activating movement of said bobbin changing means to a second bobbin change position above a shuttle race level and at least partly over said material upon each change of said bobbin;

positioning said at least one shuttle in a first position corresponding to said second bobbin change position of said bobbin changing means;

effecting a change of said bobbin in said shuttle; and joining the yarn/thread issuing from the produced material to the yarn/thread part of a new bobbin.

2. The method according to claim 1, further including the steps of forming a bobbin changer compartment including the bobbin changing means and a reed/sley of the weaving machine in which each shuttle undergoing a bobbin change assumes said second bobbin change position, and fixing said shuttle in its position during the bobbin change.

3. The method according to claim 2, further including stopping the weaving machine during each bobbin change and bringing the reed/sley to a position at or in the vicinity of the side edge of the material.

4. The method according to claim 2, wherein the bobbin changing means, at least when positioned to cooperate with the reed/sley, is assigned a position adapted to the stopped position of the reed/sley.

5. The method according to claim 1, further comprising bringing each shuttle undergoing a bobbin change to said first position corresponding to said second bobbin change position above the shuttle race by a shuttle changer, said shuttle changer operating between said first position of said shuttle and a second shuttle race position.

6. The method according to claim 1, further comprising effecting movement of the bobbin changing means between three positions including said first position at which the bobbin change takes place, said second position at which the weaving machine performs its weaving function, and a third position at a height setting above the material, where a drawing-in work/initial loading work is carried out in the weaving machine.

7. An apparatus for automatically changing a bobbin in at least one shuttle of a weaving machine which shuttle carries yarn or thread from one side of material produced by said weaving machine to the other side of said material, said apparatus comprising:

a bobbin changing means which includes at least one bobbin and means for joining yarn or thread together;

means for effecting movement of said bobbin changing means between a first position located above said material and on a side edge of said material, and a second bobbin change position above a shuttle race level and at least partly over said material upon activation of each change of said bobbin;

means for positioning said at least one shuttle at a first level corresponding to said second bobbin change position for effecting a change of said bobbin in said shuttle; and means for setting bobbin changing means at three different height setting positions including said first position at which the weaving machine performs its weaving function, said second position at which the bobbin change takes place, and a third position at which the bobbin changing means is moved to a height setting above the material where the drawing-in work/initial loading work can be carried out.

8. The apparatus according to claim 7, further including a bobbin changing compartment formed by the bobbin changing means and the reed/sley of the weaving machine at a position at or near said side edge of the material.

9. The apparatus according to claim 8, further including means for tilting said bobbin changing means to adapt to a current stop position of the reed/sley.

10. The apparatus according to claim 8, wherein each bobbin changer compartment is provided with means for securely holding the shuttle in the bobbin changer compartment.

11. The apparatus according to claim 8, wherein said means for positioning includes a shuttle changer.

12. The apparatus according to claim 11, further including means for transferring each shuttle undergoing a bobbin change from said shuttle changer to said bobbin changer compartment.

13. The apparatus according to claim 7, wherein said means for effecting movement of said bobbin changing means includes at least one guide provided in an upper structure of the weaving machine.

14. The apparatus according to claim 7, further including activating means for initiating the bobbin change in each shuttle.

15. The apparatus according to claim 14, wherein said activating means includes at least one reflection member indicating a predetermined degree of unwinding of the yarn/thread.

16. The apparatus according to claim 15, wherein said bobbin changing means includes at least one bobbin magazine including transporting members which impart displacement movements to the respective bobbins present in said bobbin magazine.

17. A method for automatically changing a bobbin in at least one shuttle of a weaving machine which carries thread from one side of material produced by said weaving machine to the other side of said material, the weaving machine including means for bobbin changing which comprise at least one bobbin and means for joining yarn/thread together, said method comprising the steps of:

placing said bobbin changing means at a first weaving position at a height level above said material and on a side edge of said material;

activating movement of said bobbin changing means to a second bobbin change position above a shuttle race level and at least partly over said material upon each change of said bobbin;

positioning said at least one shuttle in a first position corresponding to said second bobbin change position of said bobbin changing means;

effecting a change of said bobbin in said shuttle; and effecting movement of the bobbin changing means between three positions including said first position at which the bobbin change takes place, said second position at which the weaving machine performs its weaving function, and a third position at a height setting above the material, where a drawing-in work/initial loading work is carried out in the weaving machine.

18. An apparatus for automatically changing a bobbin in at least one shuttle of a weaving machine which shuttle carries yarn or thread from one side of material produced by the weaving machine to the other side of said material, the weaving machine including a reed/sley, said apparatus comprising:

a bobbin changing means which includes at least one bobbin and means for joining yarn or thread together;

means for effecting movement of said bobbin changing means between a first position located above said material and on a side edge of said material, and a second bobbin change position above a shuttle race level and at least partly over said material upon activation of each change of said bobbin;

means for positioning said at least one shuttle at a first level corresponding to said second bobbin change position for effecting a change of said bobbin in said shuttle; and means for tilting said bobbin changing means to adapt to a current stop position of the reed/sley.

* * * * *